US009359100B2

(12) United States Patent
Smith et al.

(10) Patent No.: US 9,359,100 B2
(45) Date of Patent: Jun. 7, 2016

(54) CONTAINER WITH TOP AND BOTTOM CHIMES

(75) Inventors: Andrew Smith, Durham (GB); Sergio Sonzogni, Grassobbio (IT); Philip Andrew Walton, Durham (GB)

(73) Assignee: PET ENGINEERING & SERVICES S.R.L. (IT)

( * ) Notice: Subject to any disclaimer, the term of this patent is extended or adjusted under 35 U.S.C. 154(b) by 343 days.

(21) Appl. No.: 13/261,548

(22) PCT Filed: Jun. 23, 2011

(86) PCT No.: PCT/GB2011/051176

§ 371 (c)(1),
(2), (4) Date: Apr. 9, 2013

(87) PCT Pub. No.: WO2011/161454

PCT Pub. Date: Dec. 29, 2011

(65) Prior Publication Data

US 2013/0206762 A1 Aug. 15, 2013

(30) Foreign Application Priority Data

Jun. 24, 2010 (GB) ..... 1010658.1

(51) Int. Cl.

| | |
|---|---|
| ***B65D 53/00*** | (2006.01) |
| ***B65D 1/16*** | (2006.01) |
| ***B65D 1/02*** | (2006.01) |
| ***B65D 21/02*** | (2006.01) |
| ***B65D 25/24*** | (2006.01) |
| ***B65D 50/00*** | (2006.01) |

(52) U.S. Cl.

CPC ..... *B65D 1/16* (2013.01); *B65D 1/0223* (2013.01); *B65D 21/0213* (2013.01); *B65D 25/24* (2013.01); *B65D 50/00* (2013.01); *B65D 2101/0023* (2013.01)

(58) Field of Classification Search

CPC ..... B65D 41/32; B65D 41/34; B65D 7/44; B65D 7/46

USPC ..... 220/214, 649, 729, 608, 623

See application file for complete search history.

(56) References Cited

U.S. PATENT DOCUMENTS

| | | | | |
|---|---|---|---|---|
| 4,196,818 | A * | 4/1980 | Brownbill | 215/252 |
| 2002/0050494 | A1 | 5/2002 | Rauworth et al. | |

FOREIGN PATENT DOCUMENTS

| | | | |
|---|---|---|---|
| FR | 1 440 197 | A | 5/1966 |
| GB | 2 446 392 | A | 8/2008 |
| GB | 2 446 393 | A | 8/2008 |

(Continued)

*Primary Examiner* — Jeffrey Allen

(74) *Attorney, Agent, or Firm* — Ira S. Dorman

(57) ABSTRACT

A container such as a beer keg includes a container body 1 and top and bottom chimes 2, 3. The container body has a peripheral side wall 10 provided with a plurality of circumferentially-spaced projections which are formed with the container body by a simple pressing or molding operation. Each chime is formed with a peripheral skirt 23 which fits over the peripheral side wall and a co-operating inner lip which snap-engages over the circumferentially-spaced projections. In a plastics container, the contents of the container tend to press against the projections and resist any tendency to distortion in normal use and therefore increase the strength of the attachment. In the case of the top chime 2 the skirt 23 is joined to an inner hub 21 which is additionally fixed to the container neck 12 by means of a valve assembly 4 which is screwed onto the neck. A cap 6 prevents unscrewing of the valve assembly 4 and provides immediate evidence of tampering.

5 Claims, 3 Drawing Sheets

(56) References Cited

FOREIGN PATENT DOCUMENTS

| | | | |
|---|---|---|---|
| JP | 6 345096 | A | 12/1994 |
| NL | 7 806 255 | A | 12/1978 |
| WO | WO 96 01226 | A1 | 1/1996 |

* cited by examiner

CONTAINER WITH TOP AND BOTTOM CHIMES

TECHNICAL FIELD OF THE INVENTION

This invention relates to containers, particularly kegs, which are suitable for holding beverages such as beer or fruit juices or other liquids.

BACKGROUND

Kegs for holding beverages such as beer are traditionally made of metal. After use the keg is cleaned and re-filled so that the keg may be used many times during its lifetime. Increasingly though, kegs are used to transport the contents for long distances, sometimes between continents, and transport costs can make it uneconomical to return the kegs for re-use. There is also an environmental cost to be considered in transporting heavy containers for long distances, and in disposing of containers which consume a large amount of energy in their manufacture. It is therefore becoming more common to manufacture containers from lightweight inexpensive materials such as plastics, which are cheaper to manufacture and transport.

Kegs are traditionally provided with top and bottom chimes secured to opposite ends of a container body. The top chime provides handles for handling the kegs while the bottom chime provides a stable base upon which the keg may stand. The chimes also provide protection for the container body which is easily dented or damaged, particularly if the container is moved by rolling it on its side.

In metal kegs the chimes are usually welded to the keg body, but in plastic kegs the attachment becomes more problematical. Such kegs are likely to distort in use, particularly when the filled container is tipped to one side, which places considerable stresses on the area of attachment. One possibility would be to use a suitable adhesive, but this complicates manufacture and prevents the chime from being removed, e.g. when recycling the different components. It has been proposed to attach the chime to the neck of the container by means of a central hub having a number of inwardly-extending spring tines which engage the neck of the container to hold the chime in place, but this concentrates most of the stresses in the neck region, with potential risk of damage to the container valve and/or the container seal.

Another problem with attaching the top chime directly to the container neck is that there is nothing to prevent the valve assembly from being opened or even removed to gain access to the contents of the container.

The present invention seeks to provide a new and inventive means of attachment which makes the chimes simple to fit and easy to remove but which is also reliable in use with a low risk of damage or accidental detachment. A second objective is to provide a means of preventing unauthorised access to the contents of the container, or providing a clear indication when such tampering has occurred.

SUMMARY OF THE INVENTION

The present invention proposes a container which includes a container body and a chime, the container body having a side wall and an end wall, and the container body is provided with a plurality of projections which are integrally formed with the container body spaced apart around the outside of the side wall, and the chime has a peripheral skirt which fits over the side wall with a co-operating inner lip which engages over the spaced projections.

The projections may be formed by a simple pressing or moulding operation, requiring a minimum amount of additional material. In the case of a plastics container, the contents of the container tend to press against the projections and resist any tendency to distortion in normal use, particularly if the container is pressurised. However, when the container is empty and open to atmosphere there is less resistance to distortion and it becomes much easier to forcibly remove the chime from the container body.

The engagement between the projections and the peripheral skirt may be sufficient to hold the chime in place in normal use of the container. However, in the case of a top chime the skirt may be joined to an inner hub which engages a neck formed on the end wall to assist in holding the top chime in place during lifting and handling.

The invention also provides a tamper-evident cap attached to a valve assembly which is screwed onto a container neck surrounded by an outer hub, the valve assembly having a plurality of key lugs for rotating the valve assembly, and the cap having a locking ring which is received between the valve body and the outer hub preventing access to the key lugs, and a cover portion which prevents access to the valve assembly, in which the cover portion is joined to the locking ring by a plurality of frangible connections.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
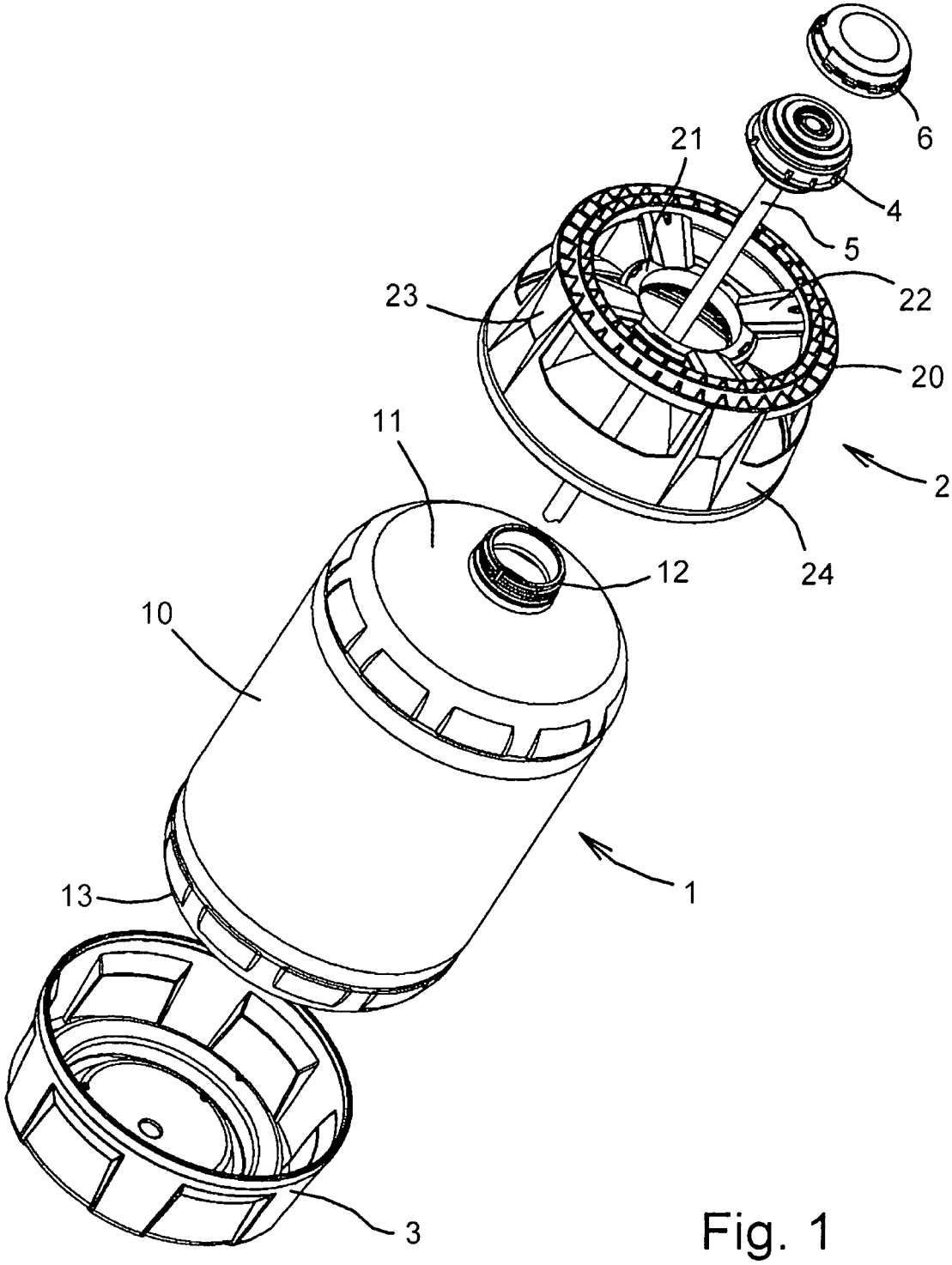
FIG. 1 is an exploded general view of a keg in accordance with the invention.

The drawings show a container in the form of a keg for holding a pressurised beverage such as beer. The keg may be formed of plastics or other recyclable materials. Referring firstly to FIG. 1, the keg comprises a keg body 1, top and bottom chimes 2 and 3, a valve assembly 4 incorporating a draw tube 5, and a tamper-evident cap 6.

The body 1 is formed in one piece, e.g. by blow moulding, and incorporates a cylindrical side wall 10, a domed top end wall 11 incorporating a central externally screw-threaded neck 12, and a domed bottom end wall 13.

The top chime 3 is again moulded in one piece and includes a ring-shaped handle 20 joined to a central hub 21 by radial spokes 22. The handle 20 is also provided with axially-extending connecting members 23 which connect the handle to a peripheral skirt 24.

The valve assembly 4 is adapted to be a screw fit onto the neck 12 and allows pressurised liquid to be withdrawn from the bottom of the keg body via draw tube 5. When the valve assembly is not engaged by a suitable fitting it closes under spring pressure to sealably retain pressurised liquid within the container. The cap 6 is engaged with the valve assembly after filling to prevent unauthorised access to the contents, as described below.

The bottom chime 3 is moulded in one piece and includes a circular base 32, shaped to sit stably on a flat surface, with a peripheral skirt 34.

Figure 2:
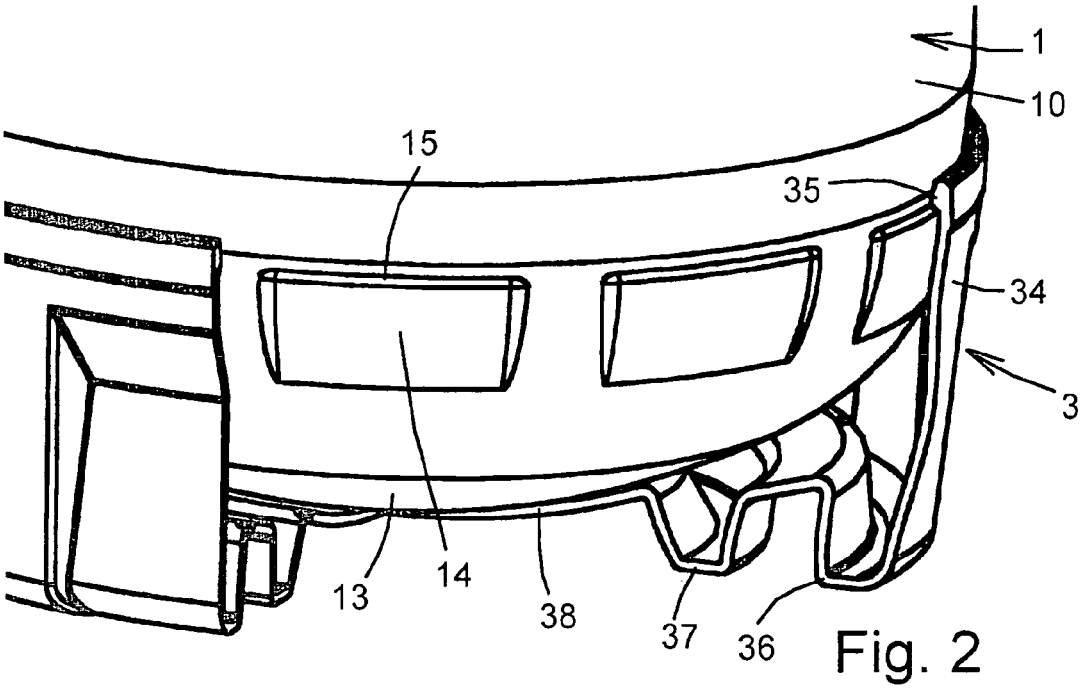
FIG. 2 is an enlarged detail of the bottom chime fitted to the assembled keg, shown partly cut-away.
Figure 3:
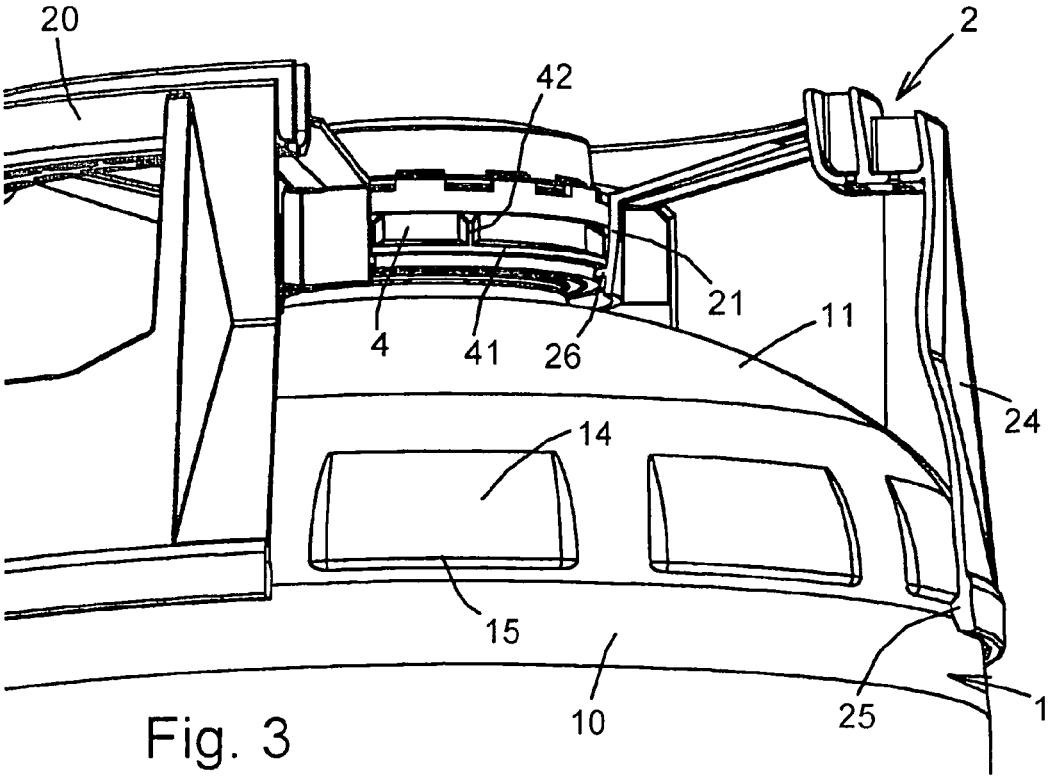
FIG. 3 is an enlarged detail of the top chime of the assembled keg, partly cut-away.

Referring to FIGS. 2 and 3, the top and bottom chimes 2 and 3 are both engaged with the keg body 1 in a similar manner. Adjacent to the top and bottom end walls 11 and 13 the side wall 10 is provided with a series of circumferentially-spaced shallow projections 14 which are formed during moulding to create an outward deformation of the side wall. Each projection 14 has a sharply-defined circumferentially-extending distal edge 15, whereas the opposite proximal edge merges seamlessly with the adjacent end wall 11, 13. The peripheral skirt 24, 34 of the respective chime 2, 3, is provided with a continuous internal lip 25, 35 so that as the chime is pushed onto the body 10 the lip travels smoothly over the projections until it snap-engages over the projections 14 to engage behind their distal edges 15.

The inherent rigidity of the keg body 1 is normally sufficient to prevent the chimes from becoming detached, although when the container is empty and open to atmosphere it is still possible to forcibly remove the chime from the container body. When the keg is filled, the contents tend to press against the projections and provide additional resistance to distortion, particularly if the container is pressurised, so that there is a much lower risk of the chimes becoming detached in use.

It will be noted in FIG. 2 that the base 32 of the bottom chine 3 is formed with concentric channel-shaped rings 36 and 37 which support the keg upon the ground and also co-operate with the handle 20 of the top chime to facilitate stacking of the kegs. The inner region 38 is dished to support the bottom wall 13 of the keg body.

Figure 4:
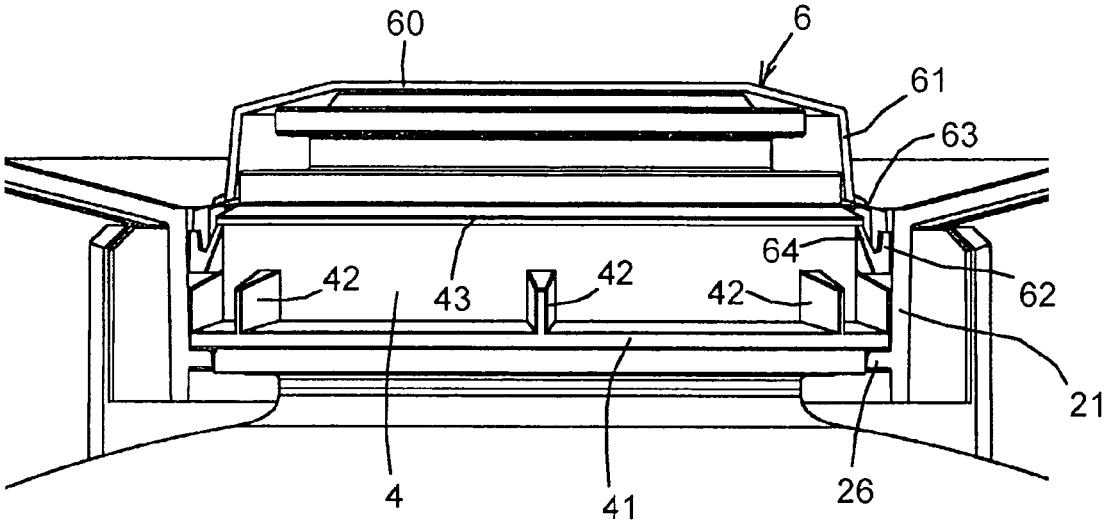
FIG. 4 is a side view of the valve and cap fitted to the assembled keg, with the top chime and cap shown in sectional detail.

When a filled keg is lifted by the handle 20 the entire weight of the contents acts between the top chime 2 and the container body 1. To assist in resisting this additional load the top chime 2 is additionally fixed to the container body via the valve assembly 4, as shown in FIGS. 3 and 4. The valve assembly 4 is formed with an annular bottom flange 41 which is provided with a series of spaced upstanding key lugs 42. These lugs are used to tighten or release the valve on the neck of the keg using a suitable driving tool. The hub 21, which is substantially cylindrical and received closely over the valve assembly 4, is provided with an internal annular flange 26 which locates beneath the bottom flange 41 so that the valve assembly holds the top chime onto the keg body by means of the flange 26.

Figure 5:
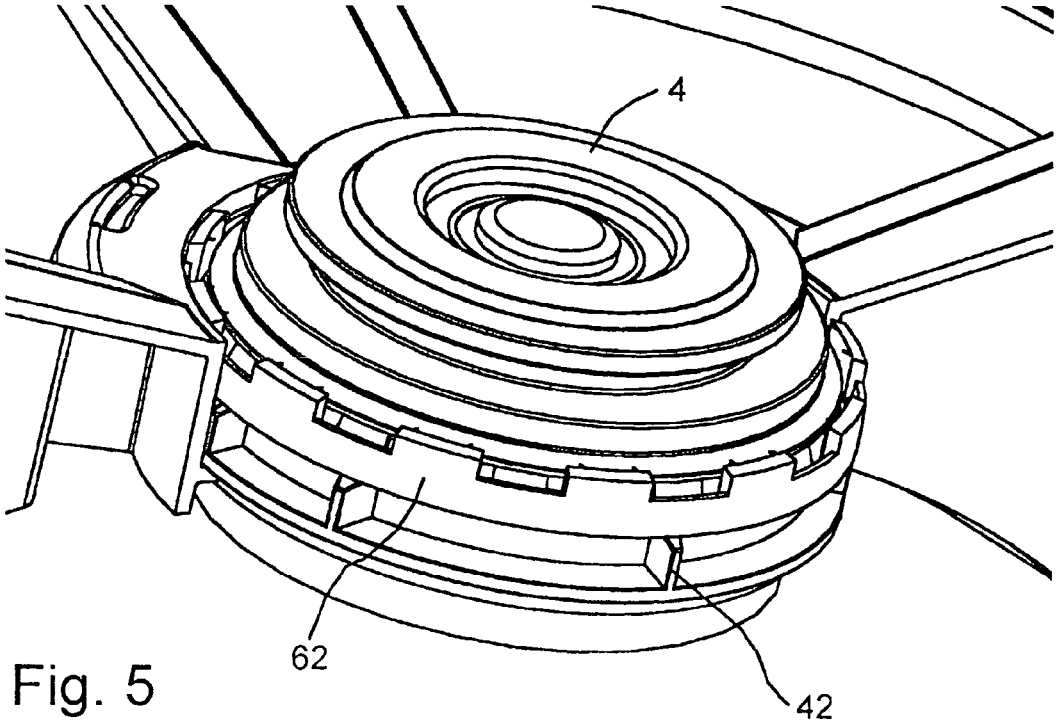
FIG. 5 is a general view of the valve fitted to the assembled keg, with the cap removed and the top chime partially cut away.

The cap 6 engages over the valve assembly 4 to prevent the contents being removed and also fills the gap between the valve assembly 4 and the hub 21 to prevent access to the key lugs 42 and prevent the valve assembly being unscrewed. As shown in FIG. 4, the cap 6 includes an upper wall 60 and a depending peripheral wall 61 which cover the upper end of the valve assembly. In addition, the cap includes a locking ring 62 which occupies the gap between the hub 21 and the valve assembly 4. The locking ring is joined to the wall 61 by a series of spaced frangible webs 63 and is also provided with a series of circumferentially-spaced spring tines 64 which project upwardly to engage beneath an upper annular flange 43 on the valve assembly 4 (as shown) or the hub 21, to prevent removal of the locking ring. In order to gain access to the valve assembly 4 it is necessary to tear the top portion of the cap away from the locking ring 62, breaking the webs 63. As shown in FIG. 5, although the valve assembly 4 is now exposed, the locking ring 62 remains in place preventing access to the key lugs 42 so that the valve assembly still cannot be unscrewed. Removal of the valve assembly 4 is only possible by forcibly removing the locking ring, which provides immediate evidence of tampering.

Whilst the above description places emphasis on the areas which are believed to be new and addresses specific problems which have been identified, it is intended that the features disclosed herein may be used in any combination which is capable of providing a new and useful advance in the art.

The invention claimed is:

1. A tamper-evident cap (6) attached to a valve assembly (4) which is screwed onto a container neck (12) surrounded by an outer hub (21) which is closely received over the valve assembly with an intervening gap between the valve assembly and the outer hub, the valve assembly having a plurality of key lugs (42) for rotating the valve assembly, and the cap having a locking ring (62) which is received between the valve assembly (4) and the outer hub (21), substantially filling the intervening gap between the valve assembly and the outer hub and preventing access to the key lugs (42), and a cover portion (60, 61) which prevents access to the valve assembly (4), in which the cover portion (60, 61) is joined to the locking ring (62) by a plurality of frangible connections (63).

2. A tamper-evident cap according to claim 1 in which the locking ring (62) is provided with spring tines (64) which engage beneath an upper flange (43) on the valve assembly (4) or the hub (21) to prevent removal of the locking ring.

3. A tamper-evident cap according to claim 2 in which said upper flange (43) is located between said cover portion (60, 61) and said key lugs (42).

4. A tamper-evident cap (6) attached to a valve assembly (4) which is screwed onto a container neck (12) surrounded by an outer hub (21) which is closely received over the valve assembly with an intervening gap between the valve assembly and the outer hub (21) and with an upper flange (43) located in said intervening gap;

the valve assembly having a bottom flange (41) projecting into said intervening gap and a plurality of key lugs (42) for rotating the valve assembly, said plurality of key lugs (42) being located in said intervening gap between the upper flange (43) and the bottom flange (41);

the outer hub (21) is provided with an internal flange (26) located beneath said bottom flange (41); and the cap (6) has a cover portion (60, 61) which prevents access to the valve assembly (4) and a locking ring (62) received between the valve assembly (4) and the outer hub (21) substantially filling said intervening gap, said locking ring (62) being provided with spring tines (64) which engage beneath said upper flange (43) to prevent removal of the locking ring, the cover portion (60, 61) being joined to the locking ring (62) by a plurality of frangible connections (63), the arrangement being such that the locking ring (62) prevents access to the key lugs (42) when the cover portion (60, 61) is removed from the valve assembly (4) upon breaking said plurality of frangible connections.

5. A tamper-evident cap according to claim 4 in which said upper flange (43) is provided on the valve assembly (4).

* * * * *